United States Patent [19]

Coulter et al.

[11] 4,202,145

[45] May 13, 1980

[54] CAST-IN-PLACE CONCRETE SLAB POURING FORM

[75] Inventors: Alton R. Coulter; Lonnie G. Hubbard; Vincent P. Johnston, all of Sheridan, Wyo.; Michael H. Rich, Westminster, Colo.

[73] Assignee: Leav-Er-Rite Mfg. Co. Incorporated, Sheridan, Wyo.

[21] Appl. No.: 961,998

[22] Filed: Nov. 20, 1978

[51] Int. Cl.[2] ..... E02D 27/00

[52] U.S. Cl. ..... 52/169.1; 52/102; 52/294; 249/3; 249/6

[58] Field of Search ..... 52/169.1, 102, 371, 52/293, 294; 249/5, 6, 3, 4; 404/69, 68, 47; 403/231, 205, 403, 402

[56] References Cited

U.S. PATENT DOCUMENTS

| | | | |
|---|---|---|---|
| 985,035 | 2/1911 | Hotchkiss | 249/9 |
| 995,630 | 6/1911 | Naugle | 249/9 |
| 2,611,169 | 9/1952 | Torrelli | 249/4 |
| 2,626,444 | 1/1953 | Wolf | 249/6 |
| 2,663,925 | 12/1953 | Yates | 249/6 |
| 2,830,683 | 4/1958 | Griffith | 52/656 |
| 3,265,879 | 4/1966 | Ford | 52/656 |
| 3,336,715 | 8/1967 | Savary | 52/656 |
| 3,397,494 | 8/1968 | Waring | 52/293 |
| 3,451,153 | 6/1969 | Dohanyos | 52/656 |
| 3,915,579 | 10/1975 | Offenbroich | 52/656 |
| 4,121,804 | 10/1978 | O'Leary | 249/6 |

*Primary Examiner*—Price C. Faw, Jr.

*Assistant Examiner*—Henry E. Raduazo

*Attorney, Agent, or Firm*—Edwin L. Spangler, Jr.

[57] ABSTRACT

This invention relates to a quickly assembled prefabricated metal concrete pouring form for slabs and the like that remains in place as an integral part of the finished structure. The basic elements of the structure are exterior wall sections with each containing a series of vertically-aligned pairs of slots arranged in parallel horizontal rows throughout the length thereof and which can be telescoped into overlapping relation to place selected pairs of these slots in registry with one another to receive the hook-forming elements of one or more types of connectors that lock the sections together in free-standing assembled condition. Two of these connectors, namely, a ground stake and a detachable endpiece of a spreader subassembly both include a vertically-spaced pair of downturned hook-forming elements to effect the locking action while the corner sections employ horizontally-spaced pairs of horizontally-disposed tongues for this same purpose. Each spreader subassembly includes a spacer formed of sheet metal folded to provide a base and upstanding opposed walls defining a slot-like channel therebetween. One of the sidewalls is internally dimpled at each end with these dimples being designed to enter apertures in an apertured extension of the endpiece so as to adjustably and detachably retain the latter in telescoped relation within the channel. Partition walls structurally similar to the exterior wall sections are used between long spans separating the latter to produce a divider.

10 Claims, 14 Drawing Figures

Fig.-1
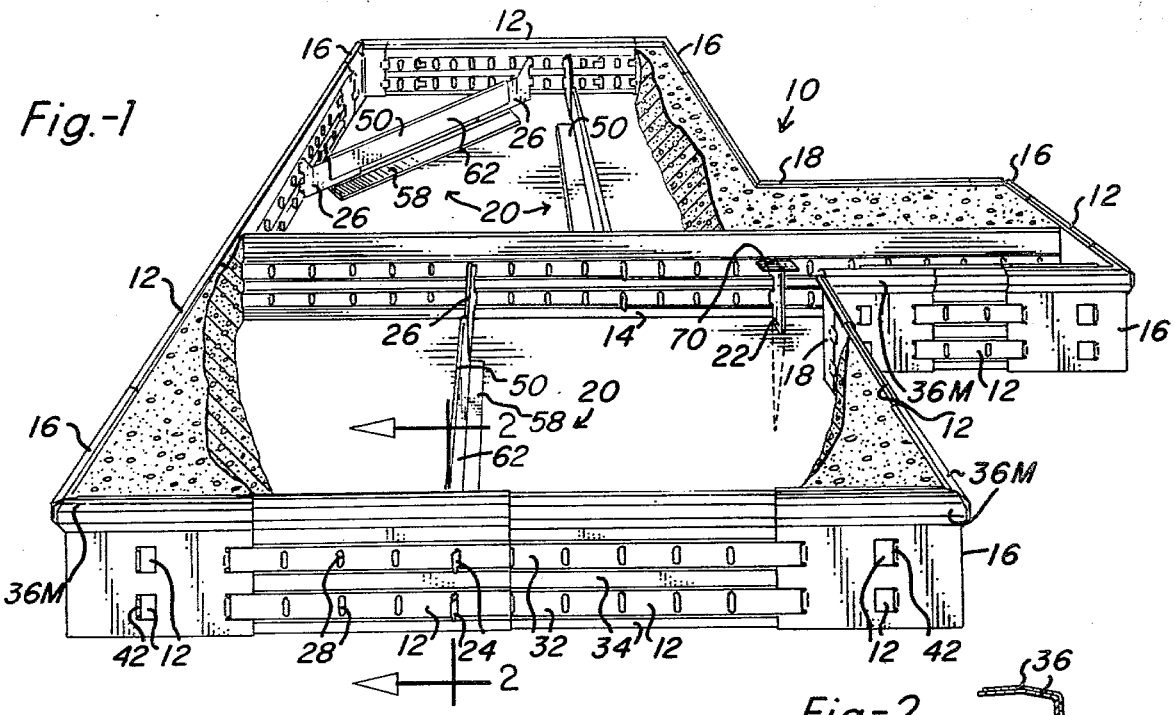
Fig.-2
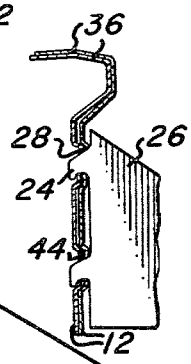
Fig.-3
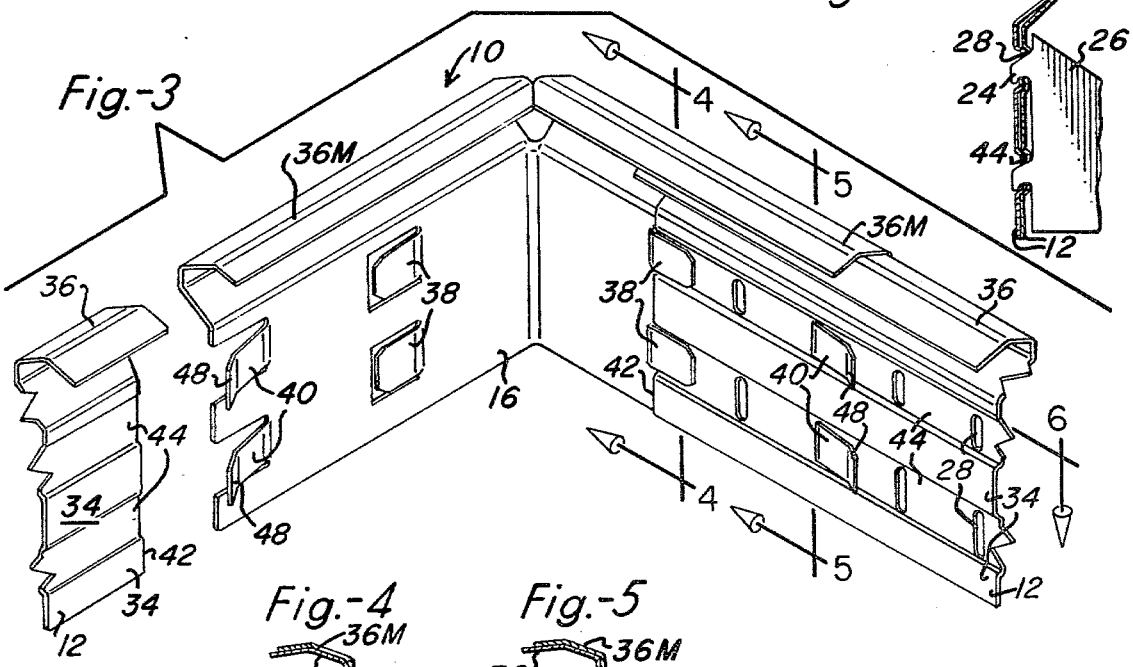
Fig.-4
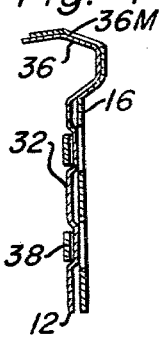
Fig.-5
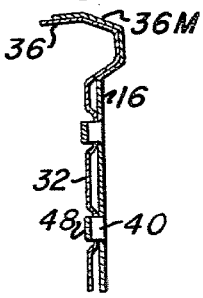
Fig.-6
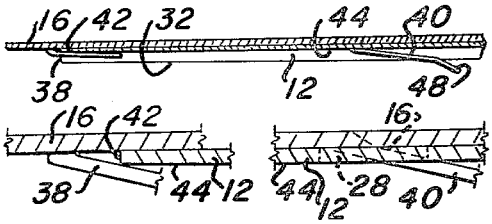
Fig.-7 Fig.-8

CAST-IN-PLACE CONCRETE SLAB POURING FORM

Prefabricated metal concrete pouring forms of one type or another are notoriously old in the art, especially those used in the construction of segmented slabs which end up as sidewalks, driveways, aircraft runways, and the like. In general, these prior art forms have sidewall members maintained in spaced, usually parallel, upstanding relation by transversely-extending spreader elements connected therebetween. Noteworthy examples of such forms are those forming the subject matter of U.S. Pat. Nos. 985,035; 995,630; 1,202,269; 1,471,074; 1,697,765; 2,843,911 and 2,950,517. Of this group, all but one or perhaps two must be stripped and reused otherwise their cost becomes prohibitive. The very fact that the major portions of these forms must be stripped and reused (the spreaders are usually left in place) requires the use of an externally-accessible knockdown assembly technique that is both time-consuming and expensive. For instance, both the Hotchkiss and Naugle patents in the above group require the use of detachable fasteners to detachably interconnect the sidewalls which are stripped from the spreaders that remain cast "in situ". Placing as well as removing each of these fasteners is a costly procedure, especially today when the cost of labor oftentimes far exceeds the cost of the material used to form a job.

Both of the above-mentioned patents show slotted sidewall sections which feature is shared with the corresponding elements of the instant pouring form. They also show tabs on the spreaders (those of Naugle even being hook-shaped) that pass through the apertures in the sidewalls to receive the fasteners. None of these spreaders, however, connects directly to the sidewall sections as in the instant invention to hold the latter permanently in fixed upright position.

Hotchkiss teaches detachably assembling his sidewall sections in abutting end-toend relation using a tongue and channel connection on the exterior surface in position to bridge the joint; whereas, Naugle accomplishes the same thing with a specially-designed telescopic joint. The instant form, while using a telescopic sidewall joint like Naugle's, goes further and locks the telescoped sections together by hooking the tongues of the spreader endpieces or stakes through registering pairs of apertures in the overlapped portions.

Beyond this point, the differences between the prior art metal slab forms as exemplified by the above patents and the instant cast-in-place forms exhibit little, if any, similarity. Those that have corner-forming elements for example, and few do, show quite different ways of handling the problem, especially since the forms are designed to be taken down and reused. The same is true even of the spacers used to maintain the sidewall sections in fixed spaced parallel relation. While these spacers oftentimes remain a part of the finished structure, nevertheless, they differ materially from those of the instant invention which, along with the sidewalls, remain assembled permanently and cooperate with one another to produce finished borders and joints between slab sections.

More specifically, the corner sections of the within-described invention, both inside and outside, employ on each right angle wing, two sets of vertically-spaced but horizontally-disposed pairs of tongues, an inside pair nearest the corner and an outside pair spaced inwardly of the free edge, the latter pair including outturned terminal ears to aid in the insertion thereof into a particular pair of the slots in a sidewall section to be attached thereto. This outer pair of slots is longer than the inner pair so as to enter the sidewall section slots in advance of the free edge of the latter being received behind the inner pair of tongues.

Another unique feature of the instant spreader subassembly is the way the hook-carrying endpieces thereof are slidably telescoped into slot-like channels formed in the ends of the spacer while, at the same time, being latched in place therein by interlocking dimples and apertures provided in opposed surfaces of the elements thus interlocked.

Lastly, the curled flange atop the sidewall and corner-forming sections provides a finished border on the slab while the folded edge on the interior or partition wall sections provides a divider for extra long or extra wide slabs. Hook-carrying stakes can be used wherever necessary to anchor any of the wall (exterior or partition) or corner sections in place instead of using the spreaders for this purpose. The spreaders can, if necessary, be used diagonally from one sidewall section to another across a corner.

It is, therefore, the principal object of the present invention to provide a novel and improved cast-in-place prefabricated metal concrete slab pouring form.

A second objective is the provision of a pouring form of the type aforementioned that is very quickly and easily assembled yet is inexpensive enough to leave as a permanent adjunct to the finished slab, sidewalk, driveway or other poured concrete deck structure.

Another objective of the within-described invention is the provision of an interlocking and self-locking metal pouring form assembly which, under most circumstances, can be assembled with no tools at all while in the remainder about all that is needed is a hammer and perhaps a hacksaw or pair of metal shears.

Still another object is to provide a hook-ended spreader for holding the sidewalls of metal pouring forms in upright fixed spaced relation that includes a novel telescopic connection that is secure against lengthwise failure yet can be assembled in the length of time it requires to slide the endpieces into the slot-like channels in the end of the spacer.

An additional objective of the invention herein described and claimed is the provision of a pouring form that requires no particular expertise to install yet results in a professionally done slab equal to anything a skilled mason can produce.

Other objects of the invention are to provide a concrete slab pouring form that is no more expensive overall than a comparable wooden form for the same purpose, one that is extremely versatile in its many applications, and a form of the type described that is lightweight yet rugged, safe, reliable, compact and even somewhat decorative.

Other objects will be in part apparent and in part pointed out specifically hereinafter in connection with the description of the drawings that follows, and in which:

FIG. 1 is a perspective view showing how the pouring form of the present invention might be assembled to form a generally T-shaped slab with a joint in the middle bisecting both the crossbar portion and the stem, portions of the slab itself having been broken away to more clearly reveal the pouring form;

FIG. 2 is a fragmentary section to a greatly enlarged scale taken along line 2—2 of FIG. 1;

FIG 3 is an exploded fragmentary perspective view to approximately the same scale as FIG. 2 showing the manner in which the corner sections are telescoped into the exterior wall sections and thus assembled thereto;

FIG. 4 is a section taken along line 4—4 of FIG. 3;

FIG. 5 is a section taken along line 5—5 of FIG. 3;

FIG. 6 is a fragmentary section taken along line 6—6 of FIG. 3;

FIG. 7 is a still further enlarged fragmentary section taken along line 7—7 of FIG. 4;

FIG. 8 is a fragmentary section to the same scale as FIG. 7 taken along line 8—8 of FIG. 5;

Figures 9, 10, 11, 12, 13, 14:
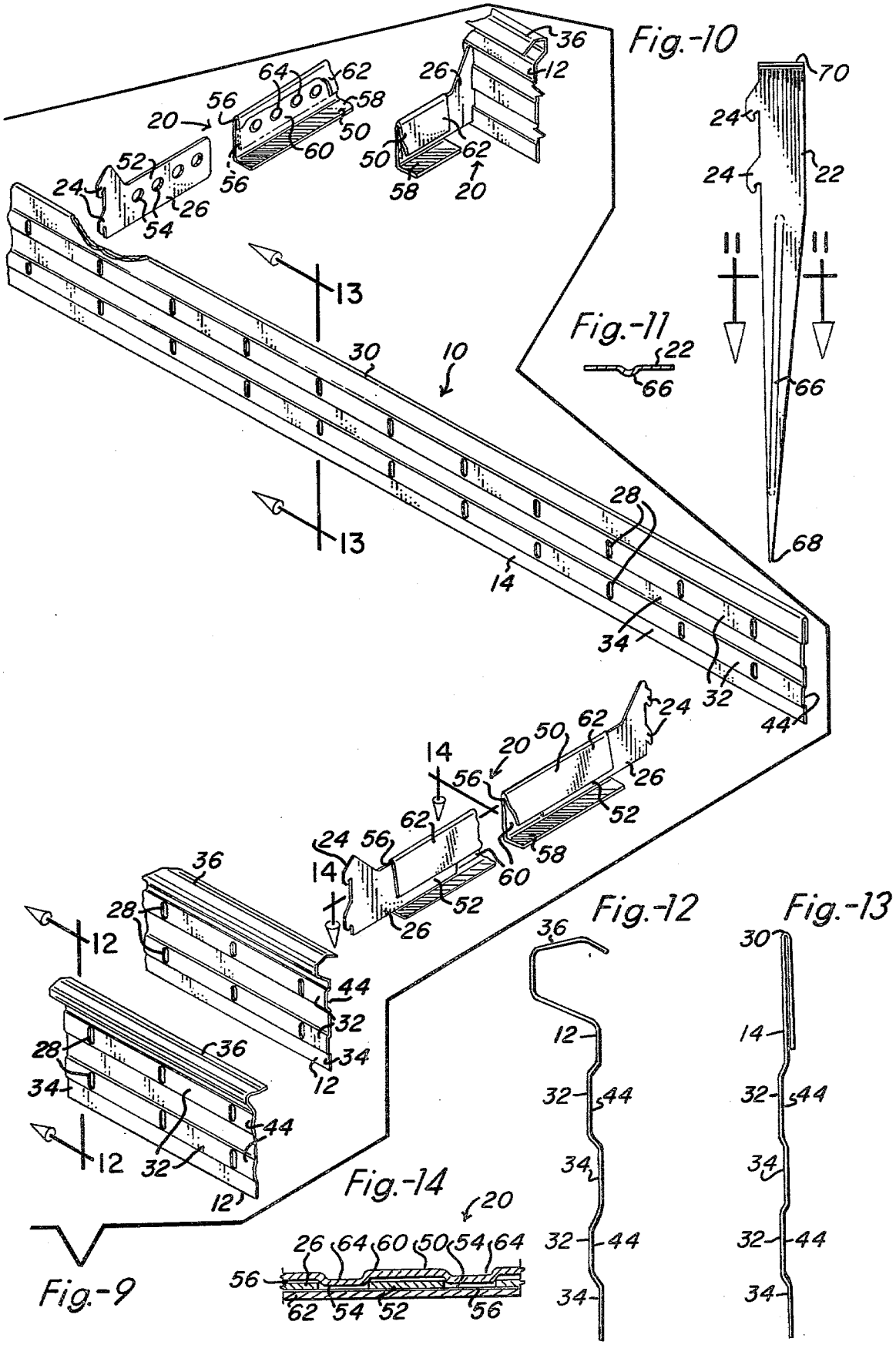
FIG. 9 is an exploded fragmentary perspective view to the same scale as FIG. 1, portions of the elements having been broken away to conserve space.
FIG. 10 is a side elevation of the stake shown at a scale approximating that of FIG. 2.
FIG. 11 is a section taken along line 11—11 of FIG. 10 slightly enlarged.
FIG. 12 is a section taken along line 12—12 of FIG. 9 to a still further enlarged scale.

FIG. 13 is a section taken along line 13—13 of FIG. 9 to the same scale as FIG. 12; and, FIG. 14 is a fragmentary section taken along line 14—14 of FIG. 9 to approximately the same scale as FIGS. 12 and 13.

Referring next to the drawings for a detailed description of the present invention and, initially, to FIG. 1 for this purpose, reference numeral 10 has been selected to broadly refer to the pouring form in its entirety while numerals 12 and 14 specifically designate the exterior and partition wall sections thereof, respectively. In like manner, numeral 16 has been used to identify the outside cornerpiece while numeral 18 is used in a similar way to refer to the inside cornerpiece. Numeral 20 identifies the three-piece spreader subassembly in a general way and numeral 22 specifically refers to a ground stake used in place of the spreader subassembly or in combination therewith to anchor the wall sections, either interior, partition or both. Two of the spreader subassemblies 20 have been shown interconnecting a partition wall 14 with sidewalls 12, the sidewall nearest the viewer having two overlapped sections with hook-forming elements 24 of the subassembly endpieces 26 passing through registering pairs of tongue-receiving slots 28 in said sidewall sections. For purposes of illustration, a stake 22 has also been shown driven into the ground and hooked into a pair of slots 28 in the partition wall thus providing an alternate means for anchoring same in upright fixed position. In most applications, the use of spreader subassemblies is preferred over the use of stakes since the former are easier and faster to install while, at the same time providing a more rigid and better aligned system. One other spreader subassembly is shown in FIG. 1 extending diagonally between a pair of exterior sidewall sections 12 across an outside corner section in the upper left-hand corner. The width of the slots 28 in relation to the thickness of the tongues 24 is such as to accommodate this 45° angular relation.

When filled with concrete, the spreader subassemblies 20 and stakes on the interior of the pouring form are, of course, buried in the resulting slab. Partition wall 14 is, likewise, permanently cast in place, however, its folded top edge 30 (FIG. 13) may remain exposed as the concrete is trowelled level with it. The longitudinally-extending shallow ribs 32 (FIGS. 12 and 13) offset from the planar body 34 of both types of wall sections 12 and 14 acts as stiffening ribs therefor and also cooperate therewith to define an irregular cross section readily anchorable in the concrete against relative upward movement. Concrete filling the unused apertures 28 assists in this same function as well as preventing relative horizontal movement.

Looking next at FIGS. 3 and 12, it will be seen that in place of the folded edge 30 along the top of the partition wall sections 14, each exterior wall section 12 together with both the outside and inside corner sections 16 and 18, respectively, all are provided with an inturned curled flange 36 that results in these elements having a generally button-hook-shaped cross section. The pouring form is assembled as shown in FIG. 1 with all of these curled flanges 36 curling inwardly so that the concrete can flow in underneath the latter. These flanges provide a permanent finished rim or border around the slab. As was the case with the partition wall edge 30, the concrete is trowelled flush with curled flanges so as to eliminate any raised projection for pedestrians to trip over.

FIGS. 3-8, inclusive, most clearly reveal the novel interlock between the exterior wall sections 12 and one wing or the other of a corner section. In all but highly specialized applications, the two right angle wings of the corner section are identical since they will ordinarily both be connected to an exterior sidewall section 12. Along the same line, so far as the interlocking feature about to be described is concerned, it is identical on both the inside and outside corner sections since the only difference between the latter is the direction in which the curled flange atop thereof curles in relation to the face of the wings upon which the tongues 38 and 40 project. The two offset ribs 32 of the wall members 12 and 14 parallel one another in vertically-spaced relation. Each of these ribs contains a row of the slots 28 which extend vertically. The slots in each row are spaced apart horizontally the same distance, preferably at intervals of ½ inch even though they have been shown spaced much farther apart in the drawings for purposes of clarity. The slots in the two rows are aligned vertically as are the tongues 24 on the stake and subassembly endpieces 26 as well as those 38 and 40 on the wings of the corner sections that are received therein.

Now, the slotted ribs in the exterior wall sections illustrated project outwardly therefrom while, by way of contrast, the horizontally disposed tongues 38 and 40 on the wings of the corner sections 16 and 18 all project onto the inside surfaces thereof. Both sets of tongues 38 and 40 are spaced apart vertically the same distance as the offset ribs 32 of the wall sections. The pair of tongues 38 nearest the right angle bend in the corner sections project horizontally in a direction opposite thereto in position to receive therebeneath the adjacent edge 42 of a sidewall section telescoped therein in the manner revealed in FIG. 2. The outwardly-offset ribs 32 of the exterior wall sections leave grooves 44 on their inside surfaces into which tongues 38 are received.

The remaining set of corner tongues 40 lie horizontally-spaced from the inner set thereof a distance such that with the edge 42 of a wall section fully seated behind the latter, tongues 40 will be in position to have been received by a selected pair of slots 28 and lie within the grooves 44 after having passed all the way through the latter. An examination of FIG. 3 will show that for ease of assembly, tongues 40 must enter the slots in the wall section in advance of the point at which the edge 42 thereof passes behind tongues 38; otherwise, it becomes most difficult to get tongues 40 into the slots. For this reason, tongues 40 are substantially longer than tongues 38 and, in addition, they have inturned end portions 48 to further facilitate the entry thereof into said slots. Once assembled as shown on the right-hand side of FIG. 2, the wall and corner section become most difficult to separate again without first bending or removing the tongues. The force necessary to separate these elements once interlocked in the manner described above easily exceeds the hydrostatic forces exerted thereon by the wet concrete poured therein. It is worthy of note that all the tongues 38 and 40 end up on the inside of the pouring form.

Now, it should, perhaps, be mentioned that the gauge and bendable nature of the metal used in fabricating these cast-in-place forms is such that they can readily be flexed and reshaped by hand to the degree necessary to telescope an exterior wall section into the mating wing of a corner section; nevertheless, since these corner sections will always be attached to an exterior wall section, the wings thereof are preferably formed with an oversized curl 36M to accommodate the latter telescopically with a more precise fit.

Directing the attention next to FIGS. 9 and 14, the three-part spreader subassembly 20 will be described in detail. It consists of two identical endpieces 26 and a third piece which, for lack of a better term, will be denominated a "spacer" and identified by reference numeral 50. Each of the two endpieces comprises a flat piece of sheet metal stamped or otherwise formed to provide on the outer end thereof a vertically-disposed pair of downturned hook-forming elements 24 adapted to enter selected vertically-aligned pairs of slots 28 in either an exterior or interior wall member and produce an interlocking connection therewith. An inwardly projecting extension 52 of the endpiece 26 has at least one, and preferably two or more horizontally aligned apertures 54 therein. The apertured insert thus defined is adapted to enter a vertically-disposed slot-like channel 56 in the adjacent end of spacer 50 where it becomes latched in a manner that will now be described.

Spacer 50 is formed from a flat sheet of metal to provide a horizontally-disposed base member 58 adapted to rest upon the ground or other surface upon which the slab is to be poured. Along one edge of this base formed integrally therewith rises an upright wall member 60 which is folded over to produce a downturned flap 62 that cooperates therewith to define channel 56 into which the extension 52 of the endpieces is inserted. One of these two channel-forming wall surfaces 60 or 62, preferably the former, is provided with one or more dimples 64 (FIGS. 9 and 14) projecting into the channel 56. These dimples are aligned and spaced to enter the apertures 54 in endpiece extension 52 thus forming an interlocking and adjustable connection therewith, the adjustability resulting from the degree of insertion of said endpiece. The channel 56 between the wall 60 and flap 62 is sized to tightly engage the extension which must be forcibly inserted therein so as to produce a secure interlocked connection. For purposes of facilitating entry of the extension into the channel, the corners of the leading edge may need to be out on the bias, as shown.

Depending upon the length of extension 52, each endpiece can provide for at least an inch of adjustment giving a minimum overall adjustment of two inches while, at the same time, providing a securely interlocked connection. The downturned hook-forming projections 24 on the outer end of the endpieces 26 merely enter and drop down into latched relation within any of the pairs of vertically-aligned slots 28 in either the exterior wall section 12 or the partition wall 14.

Digressing for the moment to FIGS. 10 and 11 where the stake 22 is shown, it will be seen that the stake includes the selfsame pair of downturned hook-forming appendages 24 as endpieces 26. A longitudinally-extending stiffening rib 66 is shown stamped or otherwise pressed into the downwardly-tapered point 68 while a head 70 is folded on the top end.

The only remaining feature that requires specific mention is the construction by which two exterior wall sections are connected together in overlapped end-to-end relation for which purpose reference will be made to FIGS. 1 and 2. The simplest and easiest way of connecting two exterior wall sections together is to open the curled flange 36 slightly on the end of one wall section and crimp the other curled flange closed so as to fit inside the latter. This is quite simply accomplished by hand although a pair of pliers makes it easier yet. Once thus reshaped, the smaller of the two curled flanges is inserted in the larger and the ribbed face of the latter forced down into mating face-to-face relation with the corresponding face of the former so as to bring the apertures 28 in the portions thus overlapped in registry with one another as shown in FIG. 2. All that now remains is to lock the two in overlapped assembled relation by inserting the downturned hook-forming appendages 24 of either the stake or spreader endpiece into a set of four registering openings. The depth of the hooks is designed to accommodate this double thickness of wall-forming material even with a small gap left therebetween because a shift of a quarter inch or so in form wall spacing is inconsequential in slab construction of the type to which the instant form is suited. Once the concrete is poured, it will force the wall structures held in fixed spaced relation by the spreader subassemblies 20 into the maximum possible separation anyway.

In closing, it is worthy of note that the interior partition walls 14 can, if necessary, be overlapped and connected in much the same way as the exterior ones by just placing the adjacent ends thereof in overlapped face-to-face relation and hooking them together. Here again, the thin gauge of the metal out of which the walls are fabricated is easily bent to whatever extent necessary to accommodate the hooks 24 passing through both.

What is claimed is:

1. The concrete pouring form for slabs and the like which comprises: a plurality of elongate sheet metal wall sections each having a body containing two horizontal rows of vertical slots spaced one above another in vertically-aligned pairs; wall anchoring means having a vertically-spaced pair of downturned hooks positioned and adapted for hooked insertion into a selected pair of wall section slots cooperating therewith to support the latter in upright position resting upon one of its edges; and, corner-forming connectors having wings disposed in right angular relation to one another, at least one of said wings having a first vertically-spaced pair of horizontally-disposed tongues positioned and adapted to enter a selected pair of wall sections slots when placed thereagainst in face-to-face overlapping relation, said corner connectors, and at least a portion of said wall sections and wall-anchoring means cooperating in assembled relation to define an enclosure effective to receive and retain wet concrete poured therein.

2. The concrete pouring form as set forth in claim 1 in which: the wall-anchoring means comprises a ground-supported subassembly having at least two telescopically interconnected sections, the first section of the two carrying the pair of downturned hook-forming elements on one end thereof and an elongate tongue-like insert with at least one aperture therein on the other, and the second of said two sections having spaced apart walls defining a slot-like channel therebetween sized to slidably receive the apertured insert, one of said channel-forming walls having at least one dimple therein projecting into the channel in position to enter an aperture in said insert upon insertion thereof, and said aperture and dimple cooperating with one another to produce an interlocking connection between said spreader elements.

3. The concrete pouring form as set forth in claim 1 in which: the wall-anchoring means comprises a sharpened stake adapted to be driven into the supporting surface upon which said slab is to be poured, the downturned hook-forming elements projecting from a side of said stake on the portion thereof that remains above ground.

4. The concrete pouring from as set forth in claim 1 in which the wall sections are provided with two horizontally-extending shallow grooves spaced one above the other, and in which the rows of slots are disposed within these grooves.

5. The concrete pouring form as set forth in claim 1 in which: said wall sections include exterior wall sections as a part of the concrete-retaining enclosure and interior wall sections defining partition walls between exterior wall sections, and in which each of said exterior wall sections has the body thereof bordered along its top edge by an inwardly-curled flange cooperating therewith to give said section a generally buttonhook-shaped cross section, said flange being positioned and adapted to receive the wet concrete therebeneath and produce a convex smooth surface rim bordering the slab.

6. The concrete pouring form as set forth in claim 1 in which: the first pair of tongues open away from the corner of the connector, and in which said tongue-carrying wing includes at least a third relatively shorter tongue facing in the same direction as the first pair, said third tongue being positioned and adapted to receive and retain therebehind the adjacent end of a wall section following insertion of said first pair into a particular pair of slots spaced inwardly of said adjacent end.

7. The concrete pouring form as set forth in claim 2 in which: said second section comprises a spreader adapted for telescopic connection to first sections on both ends thereof.

8. The concrete pouring form as set forth in claim 2 in which the first and second sections include a plurality of interengageable dimples and apertures effective to define an adjustable length coupling therebetween.

9. The concrete pouring form as set forth in claim 4 in which the interior partition wall sections have the upper marginal edges thereof folded over to provide a downturned flap.

10. The concrete pouring form as set forth in claim 6 in which the first pair of tongues include outturned end portions adapted to enter the slots in the wall sections and guide the remainder of said tongues therethrough upon relative face-to-face movement between said wall section on corner connector.

* * * * *